US005507068A

United States Patent [19]

Fan et al.

[11] Patent Number: 5,507,068

[45] Date of Patent: Apr. 16, 1996

[54] HANDHELD FLUID EXTRACTION CLEANER AND DRIER

[75] Inventors: Hung Fan, Taichung, Taiwan; William R. Brokaw, Kirkland, Wash.

[73] Assignee: AquaBroom Products Corporation, Kirkland, Wash.

[21] Appl. No.: 264,352

[22] Filed: Jun. 22, 1994

[51] Int. Cl.[6] ..... A47L 5/26

[52] U.S. Cl. ..... 15/320; 15/344; 15/353

[58] Field of Search ..... 15/320, 344, 353

[56] References Cited

U.S. PATENT DOCUMENTS

| | | | |
|---|---|---|---|
| 3,616,482 | 11/1971 | Brycki | 15/353 X |
| 4,179,769 | 12/1979 | Lundquist | 15/353 |
| 4,341,540 | 7/1982 | Howerin | 15/353 X |
| 4,536,914 | 8/1985 | Levine . | |
| 4,542,557 | 9/1985 | Levine . | |
| 4,597,124 | 7/1986 | Williams, III et al. . | |
| 4,776,058 | 10/1988 | Garner et al. | 15/353 X |
| 4,788,738 | 12/1988 | Monson et al. . | |
| 4,920,608 | 5/1990 | Hult et al. | 15/344 X |
| 4,930,178 | 6/1990 | Monson et al. . | |
| 5,289,610 | 3/1994 | Monson . | |
| 5,367,740 | 11/1994 | McCray | 15/344 X |
| 5,377,383 | 1/1995 | Christensen | 15/353 |
| 5,392,490 | 2/1995 | Monson | 15/353 X |

*Primary Examiner*—Chris K. Moore

*Attorney, Agent, or Firm*—Sixbey, Friedman, Leedom & Ferguson

[57] ABSTRACT

The handheld fluid extraction cleaner includes a body having a forward end, a rearward end, and a top wall extending between the forward and rearward ends. A fluid container unit is removably mounted on the cleaner body between the forward and rearward ends thereof, and the fluid container is spaced from the top wall of the body. A plenum chamber is provided in spaced relationship to the forward and rearward ends of the body, and the plenum chamber extends from the top wall to an open end which opens into the fluid container. A vacuum unit is mounted on the cleaner body and is operative to create a reduction of pressure in the plenum chamber, and the vacuum unit communicates with the plenum chamber in an area adjacent to the top wall of the body. A nozzle is formed at the forward end of the cleaner body for contacting a surface to be cleaned, and a fluid conduct extends from the nozzle to the fluid container and opens into the fluid container at a point adjacent to the open end of the plenum chamber. The nozzle can be closed by a closure unit which creates a passage from an ejector for the fluid in the fluid container to the internal nozzle chamber to flush the cleaner unit.

34 Claims, 7 Drawing Sheets

FIG. 6
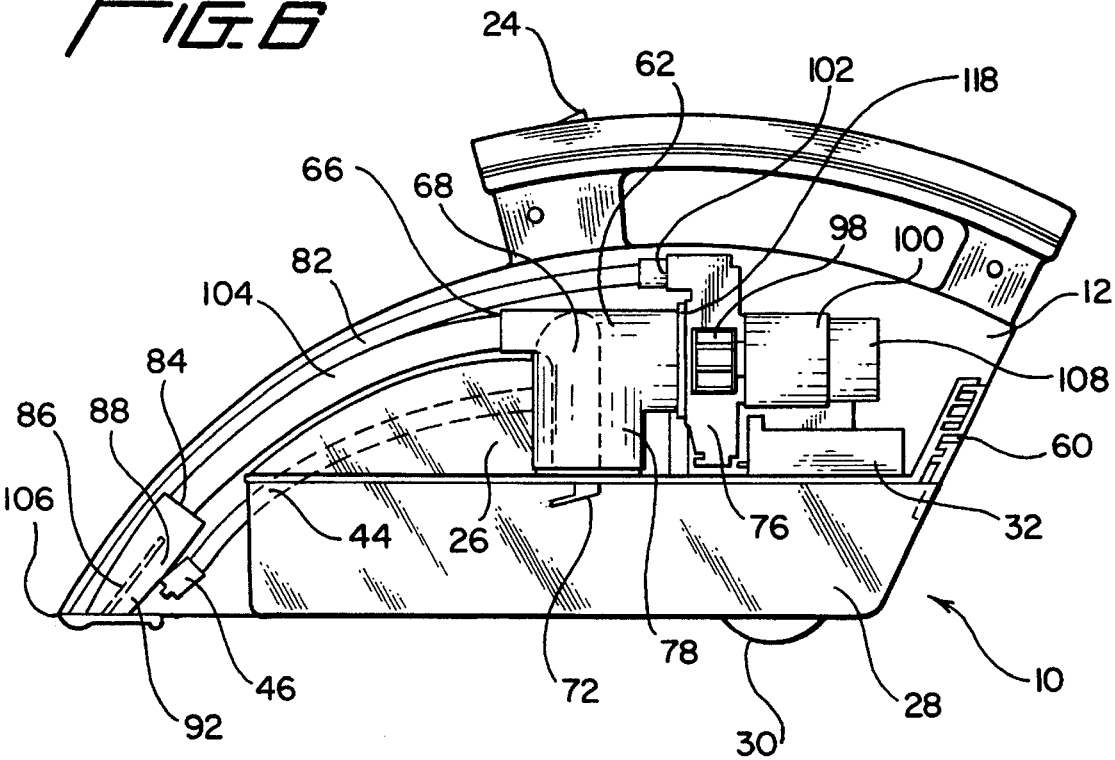
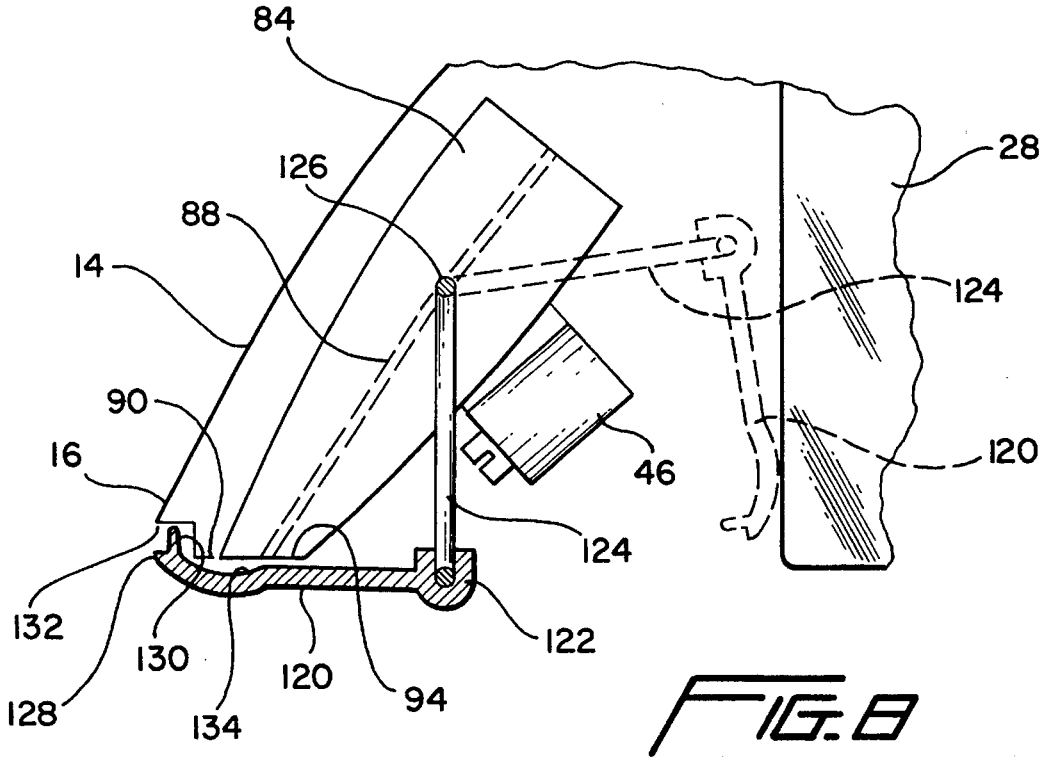
FIG. 8

HANDHELD FLUID EXTRACTION CLEANER AND DRIER

TECHNICAL FIELD

The present invention relates generally to fluid extraction cleaners and more specifically to a handheld cleaner which is compact, light-weight, portable and which applies cleaning fluid to a soiled area of a surface and then extracts the applied fluid.

BACKGROUND ART

Cleaning machines of the type wherein a washing liquid is fed from a receptacle to a surface to be washed and then, by means of suction, is returned to the original receptacle for further use, preferably after being filtered, are known. Often these units include a tank-like receptacle that houses a pump for dispensing the cleaning liquid, a suction fan for returning the liquid, and a filtering means, while also providing the storage facility for the cleaning liquid. The tank-like receptacle is designed to sit on the floor and flexible liquid discharge and liquid return hoses connect the tank-like receptacle with a cleaning head used to apply and retrieve the cleaning liquid from the surface being cleaned.

While devices of the aforementioned type are portable, they are anything but compact and lightweight, particularly when their cleaning fluid tank is full. Furthermore, the presence in such apparatus of a separate tank that must rest on the floor not only makes use of the apparatus cumbersome, but is restrictive with respect to the places that such a unit can be effectively utilized. For example, long flights of steps having no landing upon which the tank can rest can render the apparatus unusable. Furthermore, because of the cumbersome nature of such units, it is often impractical to utilize the unit for spot cleaning purposes, such as cleaning up a small spill, as opposed to general room cleaning.

As a result, it is desirable to have a cleaning apparatus wherein all of the operative components are mounted upon a common element so that the unit is unencumbered by a separate floor-supported tank. In view of this, floor cleaning devices have been configured to be similar to an upright vacuum cleaner or so-called electric broom, and have all of the operative components for spraying a cleaning fluid onto a floor surface, such as a carpet, and for using suction to collect the dirty cleaning liquid, as well as a means for storing the fluid that is applied and collected mounted upon a common element. The versatility of such "common element" type cleaning apparatus is severely restricted to floor-type uses because these units are too large and heavy to be used in a manner that is unsupported by contact with the floor surface to be cleaned and because the units are not designed for operation in orientations that would be necessary for cleaning vertical surfaces.

To overcome these disadvantages, relatively small, lightweight, portable handheld cleaning units have been developed which apply cleaning fluid to a surface area that can be cleaned with a single application of a limited quantity of cleaning fluid carried by the unit. U.S. Pat. Nos. 4,788,738 and 4,930,178 to Monson et al. and 4,536,914 and 4,542,557 to Levine shown cleaners of this type.

A problem encountered with previous handheld cleaning units is to effectively separate fluid from air within the unit when the fluid-air mixture is extracted from a surface to be cleaned. In a cleaning unit having the capability of providing a high suction force for effective cleaning, fluid entrained in air tends to be drawn into the vacuum blower for the unit and could ultimately result in damage to the vacuum blower.

Also, existing hand held extraction cleaners generally recycle dirty fluid into the same receptacle which contained the clean fluid originally applied to the surface to be cleaned. For many applications, this is unsatisfactory for recycled fluid can be contaminated or dirty enough to add to a stain to be cleaned. This is particularly true when the internal fluid paths within a cleaner become dirty or contaminated, for previous hand held cleaners provided no means for flushing these internal fluid paths.

Finally, previous hand held fluid extraction cleaners were not suitable for use in removing contaminants, such as spilled blood or other contaminated fluids, as the cleaner would remain contaminated after a single use.

DISCLOSURE OF THE INVENTION

From the foregoing, it should be appreciated that there is a need for a fluid extraction cleaning apparatus that is relatively small, lightweight, easily portable, and versatile. It is, thus, a primary object of the present invention to achieve such a cleaning apparatus.

It is a further object of the present invention to construct a fluid extraction cleaning apparatus of the initially-mentioned type that is simple and easy to use.

Yet another object of the present invention is to enable a fluid extraction cleaning apparatus to be achieved that is amenable to portable, hand-held use and does not require floor support.

Still further, it is an object of the present invention to provide a fluid extraction cleaning apparatus of the aforementioned type that can be placed in various orientations, while loaded with cleaning solution, without damaging the apparatus or producing spillage.

Yet a further object of the present invention is to provide a fluid extraction cleaning apparatus capable of using clean fluid contained in the apparatus to flush the internal fluid path within the apparatus.

Another object of the present invention is to provide a fluid extraction cleaning apparatus which includes a novel plenum chamber designed to effectively separate air from the dirty fluid extracted from a surface by the apparatus.

Still another object of the present invention is to provide a fluid extraction cleaning apparatus suitable for removing contaminants from a surface and retaining such contaminants in a disposable portion of the cleaning apparatus.

A still further object of the present invention is to provide a fluid extraction cleaning apparatus which includes a collapsible clean fluid container to conserve space.

These and other objects of the present invention are achieved in accordance with the preferred embodiments by forming a cleaner casing or body for enclosing internal cleaner components which includes a forward end, a rearward end, and a top wall extending between the forward and rearward ends. A fluid container unit is removably mounted on the cleaner body between the forward and rearward ends thereof, and the fluid container is spaced from the top wall of the body. A plenum chamber on the cleaner body is provided in spaced relationship to said forward and rearward ends thereof, and the plenum chamber extends from the top wall to an open end which opens into the fluid container. A vacuum unit is mounted on the cleaner body and is operative to create a reduction of pressure in the plenum chamber, and the vacuum unit communicates with the plenum chamber in an area adjacent to the top wall of the body.

A nozzle is formed at the forward end of the cleaner body for contacting a surface to be cleaned. The nozzle includes an internal nozzle chamber and a fluid receiving opening connecting the nozzle chamber to the exterior of said nozzle. A fluid conduct extends from the nozzle chamber to the fluid container and opens into the fluid container at a point adjacent to the open end of the plenum chamber. The nozzle can be closed by a closure unit which creates a passage from an ejector for the fluid in the fluid container to the internal nozzle chamber to flush the cleaner unit.

BRIEF DESCRIPTION OF THE DRAWINGS

FIG. 6 is a cutaway side elevational view of the extraction cleaner of FIG. 1;

FIG. 8 is a side elevational view of a nozzle cover for the extraction cleaner of FIG. 1;

BEST MODE FOR CARRYING OUT THE INVENTION

Figure 1:
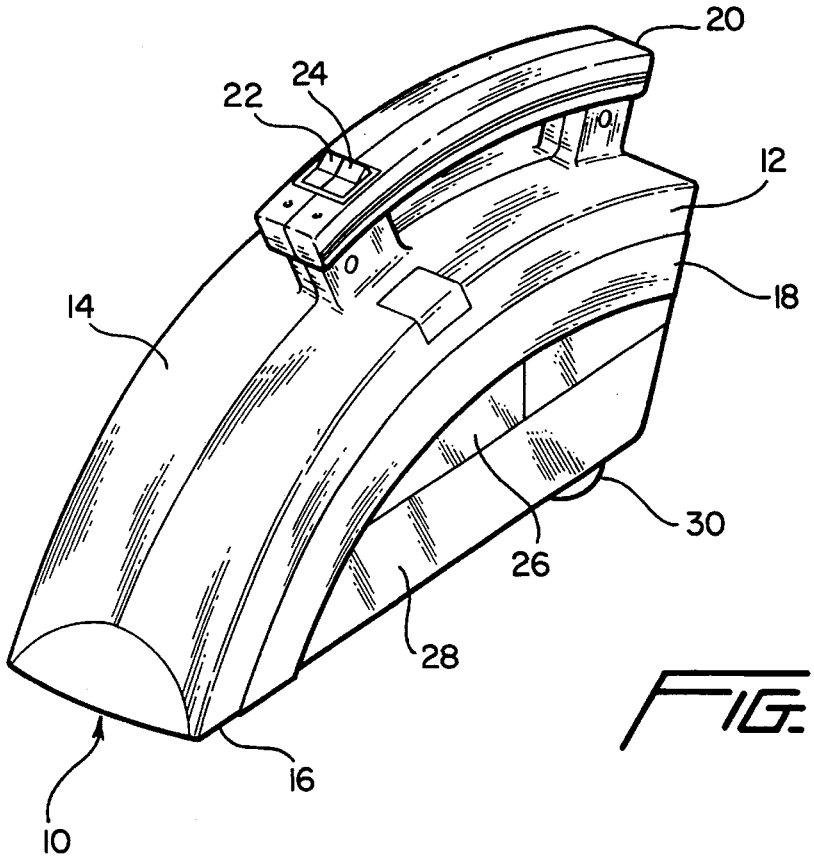
FIG. 1 is a perspective view of the handheld fluid extraction cleaner of the present invention.

Referring to FIG. 1, the handheld fluid extraction cleaner of the present invention indicated generally at 10 includes a body or casing member 12 for mounting some internal cleaner components. The casing member has a curved top wall 14 which extends from the forward or nozzle end 16 of the cleaner 10 to the rearward end 18 of the cleaner. A curved handle 20 is secured to, and projects upwardly from, the top wall 14, and the handle mounts a pump activation switch 22 and a blower motor switch 24. A clean water tank 26 and a dirty water tank 28 are removably mounted on the casing member 12, and the rear end of the dirty water tank is provided with a projecting support foot 30 to raise the rearward end of the cleaner 10 above a support surface and to tilt the cleaner toward the nozzle end. The clean and dirty water tanks are preferably formed as a one piece removable unit, but these tanks could also be formed by separate units.

Figure 2:
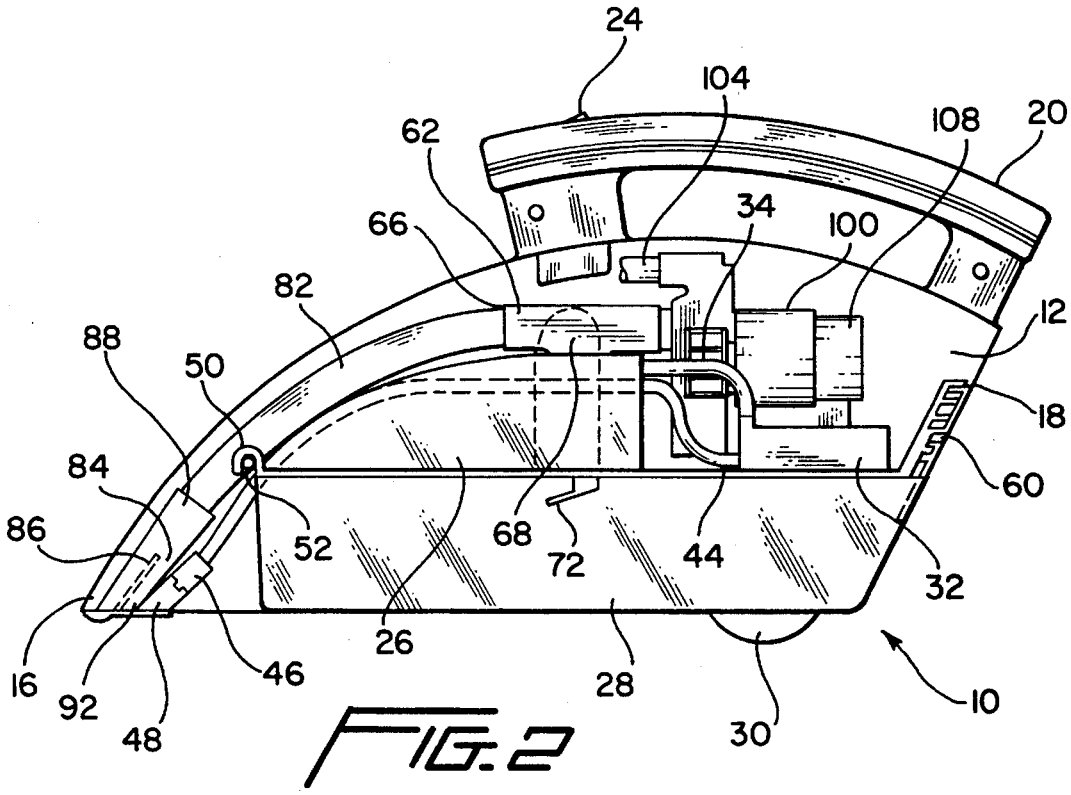
FIG. 2 is a cutaway side elevational view of the extraction cleaner of FIG. 1.
Figure 3:
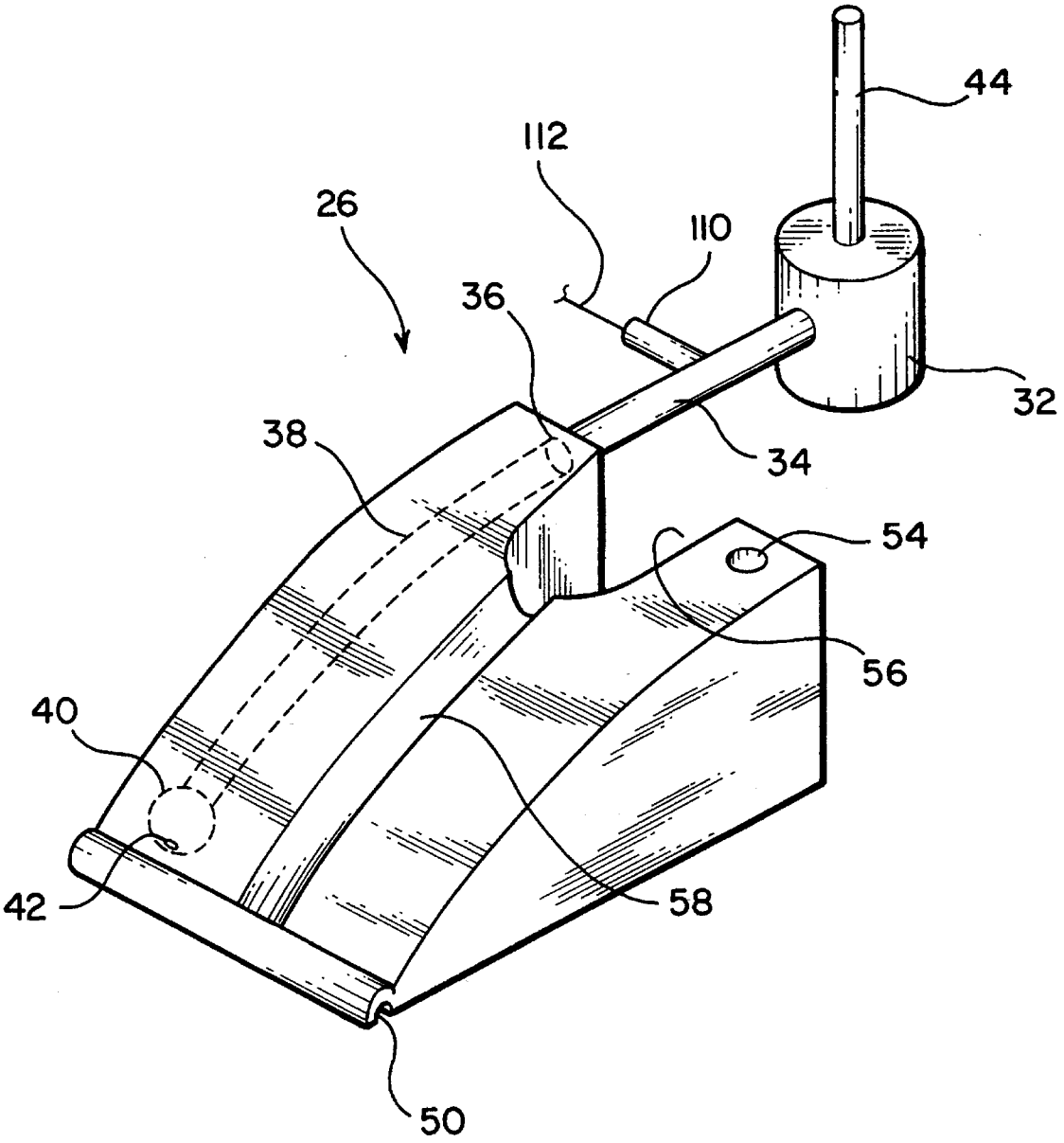
FIG. 3 is a perspective view of the clean water tank and pump for the extraction cleaner of FIG. 1.

FIGS. 2 and 3 illustrate the flow path for water or other fluid contained in the clean water tank 26. Water or other cleaning fluid from the clean water tank 26 is pumped out of the tank by an electrically driven pump 32. The pump 32 has an inlet conduit 34 that is connected to an opening 36 in the clean water tank. Inside the tank, a flexible line 38 is connected to the inlet conduit 34, and the end of the line 38 is provided with a weight 40 having a fluid inlet opening 42 formed therein. Thus water or other fluid within the tank 26 is pumped by means of the pump 32 through the inlet opening 42, the flexible line 38 and the inlet conduit 34 to the pump 32. The fluid is then pumped outwardly through an output conduit 44 which extends to a fluid spray nozzle 46 mounted at the nozzle end 16 of the casing 12. Spray nozzle 46 sprays water or other fluid out through a fluid opening 48 in the bottom of the casing 12.

The forward end of the clean water tank 26 is provided with a curved flange 50 which snaps over a rod 52 that extends across between the sides of the casing 12. The clean water tank is provided with a fill opening 54 which can be closed by a cap or other suitable means. The rear portion of the clean water tank is U-shaped and includes an opening 56 to permit the tank to fit around a plenum chamber to be subsequently described. The central portion of the upper wall of the clean water tank is provided with an indentation 58 extending longitudinally of the tank to receive conduits, such as the output conduit 44, which run to the nozzle end of the casing 12. Both the inlet conduit 34 and the flexible line 38 can be formed as an elongated, one piece flexible tube, which will flex outwardly to permit the clean water tank 26 to be removed from the casing 12 for filling. Conversely, the flexible line 38 may be permanently mounted within the clean water tank, while the inlet conduit 34 removably snaps in place to permit the clean water tank to be removed from the casing. As the clean water tank is tilted when the handheld fluid extraction cleaner 10 is moved to different orientations, the weight 40 will move the flexible line 38 so that the inlet opening 42 is always immersed in fluid contained in the clean water tank 26.

As previously described, the clean water tank 26 and dirty water tank 28 are normally formed as a one piece unit, and therefore both are supported on the casing 12 by the curved flange 50 and by a suitable release clip 60 connected to the opposite end of the dirty water tank which engages a hook mechanism formed on the casing 12. Thus, the release clip 60 can be activated to drop the rear portion of the combined clean and dirty water tanks outwardly until the curved flange 50 can be removed from the rod 52. This allows dirty water to be emptied from the tank 28 and clean water to be added to the clean water tank 26.

Figure 4:
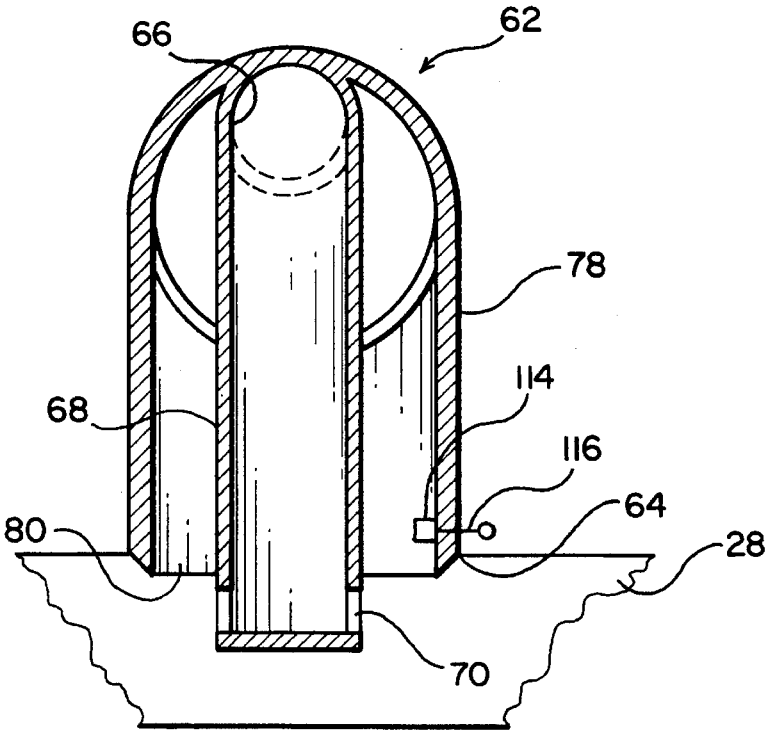
FIG. 4 is a sectional view of the plenum assembly for the extraction cleaner of FIG. 1.
Figure 5:
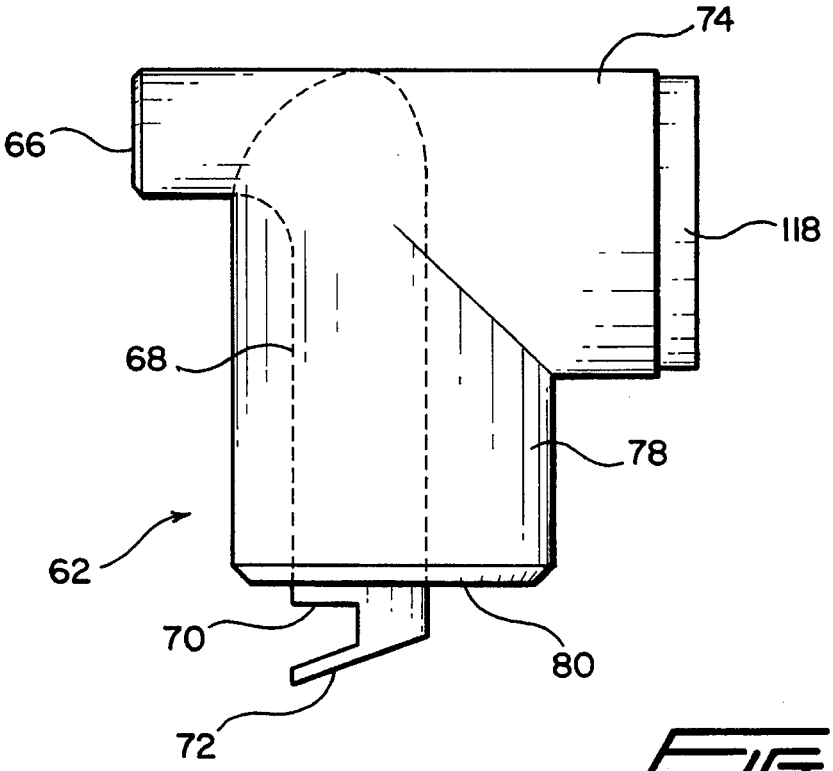
FIG. 5 is a side elevational view of the plenum assembly of FIG. 4.
Figure 7A:
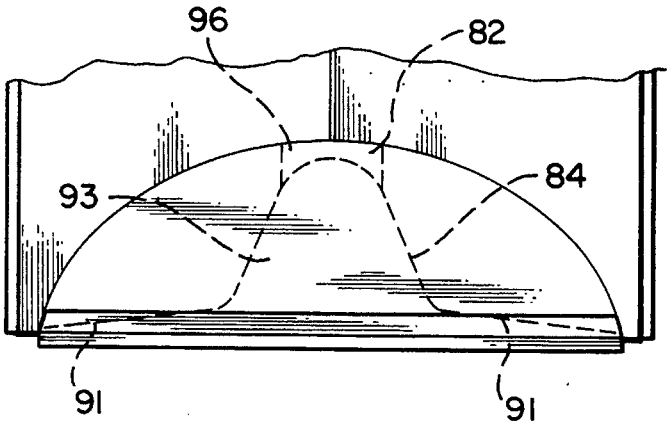
FIG. 7*a* is a view in front elevation of the vacuum nozzle for the extraction cleaner of FIG. 1.
Figure 7B:
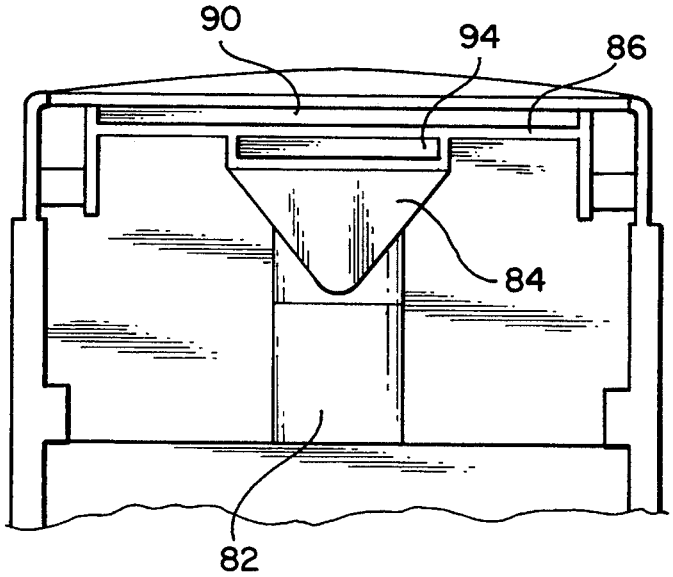
FIG. 7*b* is a bottom elevational view of the vacuum nozzle of FIG. 7*a;*
Figure 7C:
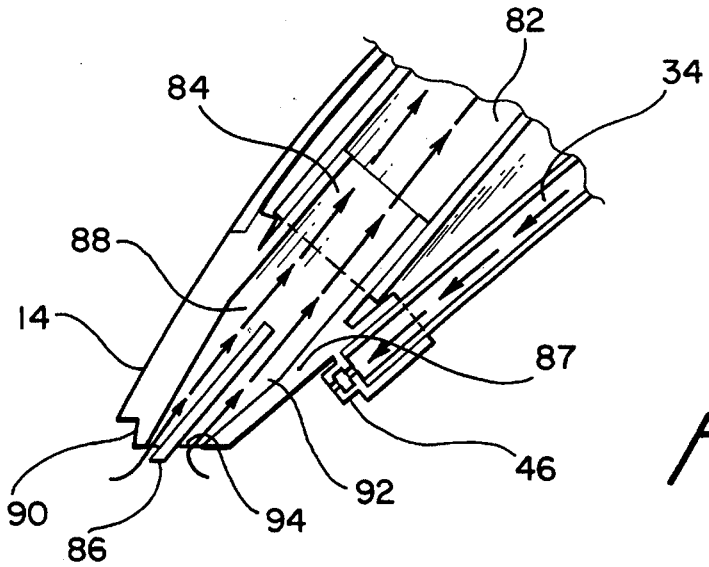
FIG. 7*c* is a sectional view of the vacuum nozzle of FIG. 7*a;*

Referring now to FIGS. 4–6, the novel plenum assembly indicated generally at 62 for the handheld fluid extraction cleaner 10 is illustrated. This plenum assembly fits into an opening 64 in the top wall of the dirty water tank 28 when this tank is in place within the casing 12. The plenum assembly is a "T" shaped unit having an inlet port 66 extending into a plenum chamber adjacent to the top wall 14 of the casing 12 and which curves downwardly into a vertical conduit portion 68 which extends downwardly through the plenum chamber. This vertical conduit forms a vertical column for fluid which ends at an opening 70 formed in the side of the vertical conduit 68 at the lower end thereof. The lowermost extremity of the opening 70 is defined by a downwardly inclined lip 72 which, with the opening 70, directs fluid downwardly into and across the dirty water tank 48 toward a side or an end of the tank.

The plenum assembly 62 also includes a vacuum port 74 which is connected to a vacuum chamber 76. A lowering of the pressure in the vacuum chamber causes a lowering of pressure within the plenum assembly through the vacuum port 74, and thus the lowering of pressure within a plenum chamber 78 which surrounds the vertical conduit 68. The plenum chamber has an open end 80 which opens into the dirty water tank 28, and thereby causes a reduction in pressure within the dirty water tank. The vertical conduit 68 extends through the open end 80 of the plenum chamber so that the opening 70 is positioned within the dirty water tank.

The inlet port 66 is connected to a conduit 82 which extends to a suction nozzle mounted in the nozzle end 16 of the casing 12. This suction nozzle, as illustrated in FIGS. *7a*, *7b* and *7c*, includes a curved, bell shaped chamber 84 divided into two sections by a divider wall 86. The first section 88 communicates with the surface below the cleaner by means of a forward slit opening 90, while the second section 92 communicates with the surface by means of a smaller slit opening 94. Both the first and second sections 88 and 92 communicate with an outlet opening 96 positioned in the reduced top section of the bell shaped suction chamber 84. The lowermost end of the conduit 82 is connected to the outlet opening 96. It is important to note that the divider wall 86 extends outwardly beyond the front wall 14, which is of clear plastic in the area of the chamber 84, and a chamber rear wall 87. This insures that at least one of the slit openings 90 and 94 will be spaced above a surface to draw fluid if, due to the incline of the cleaner 10, the remaining slit opening is blocked. Fluid drawn through the wide forward slit opening 90 is drawn up the sidewalls 91 of the bell shaped chamber to the chamber central section 93 of reduced cross section.

Referring now to FIG. 6, a vacuum generating impeller 98 driven by an electric motor 100, is mounted within the vacuum chamber 76. Exhaust air from the vacuum chamber under pressure is passed through an outlet port 102 connected to the vacuum chamber and down through a conduit 104 to an air outlet opening 106 formed in the nozzle end of the casing 12. This exhaust air operates to dry the surface beneath the handheld fluid extraction cleaner 10.

Both the electric motor 100 and the pump 32 are powered by a power source 108 which may constitute a battery pack or a source which is connected to external power through a power cord (not shown). The power source 108 is connected to the motor 100 through the blower motor switch 24 and is likewise connected to the pump 32 through the pump activation switch 22.

In the operation of the handheld fluid extraction cleaner 10, a user first activates the pump activation switch 22 which causes clean water or cleaning fluid to be drawn from the clean water tank 26 by the pump 32 and supplied under pressure by the output conduit 44 to the fluid spray nozzle 46. Fluid from the fluid spray nozzle is sprayed on the surface to be cleaned beneath the nozzle end 16 of the extraction cleaner, and then the blower motor switch 24 is activated. Activation of the blower motor switch causes the motor 100 to rotate the vacuum impeller 98 to create a reduced pressure in the vacuum chamber 76. This reduced pressure is transmitted by the plenum chamber 78 to the dirty water tank 28 causing fluid to be drawn through the slit openings 90 and 94 of the suction nozzle 84. This fluid is transmitted by the conduit 82 to the inlet port 66 and the vertical conduit 68 and flows downwardly into contact with the inclined lip 72. This inclined lip and the opening 70 direct the fluid away from the vertical conduit against the sides of the dirty water tank 28 while the lighter air is drawn by the low pressure in the plenum chamber 78 through the vacuum port 74 and into the vacuum chamber 76. Air in the vacuum chamber is exhausted through the exhaust port 102 and conduit 104 to the air inlet opening 106 and operates to dry the surface from which the fluid has been withdrawn.

It will be noted that the plenum assembly 62 is located substantially in the center of the dirty water tank 28, and the plenum chamber 78 is positioned in the opening 56 formed in the clean water tank 26. This central location of the plenum assembly permits the handheld fluid extraction cleaner 10 to be tilted vertically upwardly, vertically downwardly, or at various angles inbetween without fluid from the dirty water tank being permitted to pass into the vertical conduit 68 or the plenum chamber 78. This is due to the fact that the fluid volume contained in the clean water tank 26 is less than one half of the total volume of fluid which will be contained in the dirty water tank if this tank was oriented in the vertical position.

A first liquid sensor 110 is provided in the inlet conduit 34 and is electrically connected by means of a line 112 to the electrical circuit for the pump 32. This sensor is activated when the pump is activated, and if the sensor does not sense fluid in the line 34 after a predetermined delay period, the sensor will operate to deactivate the pump to prevent the pump from burning out when the clean water tank 26 is empty.

Similarly, a second liquid sensor 114 is provided in the plenum chamber 78 adjacent to the open end 80 thereof, and this sensor is connected by means of an electrical connection 116 to the circuit for the vacuum impeller motor 100. If this sensor senses the presence of water in the plenum chamber, it operates to shut off the impeller motor.

To further insure that water or other liquid contaminants do not reach the vacuum chamber 76, a fluid resistant filter medium 118 may be placed between the vacuum port 74 and the vacuum chamber 76. This fluid resistant filter medium is of the type which permits air to pass through the filter medium while resisting the passage of fluid. A number of known filter mediums of this type are available and may be formed of sintered metal or plastic cloth like materials having small through passages.

Referring now to FIG. 8, the handheld fluid extraction cleaner 10 is provided with an assembly which enables the unit to be self flushing. This assembly includes a cover member 120 having a first end 122 which is pivotally mounted on a pivotal hanger member 124. The hanger member is U-shaped in configuration to extend across the bottom of the extraction cleaner, and on opposite sides includes projecting legs 126 which extend into the sides of the casing 12. The cover member 120 includes a second end 128 having an upwardly extending lip 130 which engages a notch 132 in the top wall 14 of the cleaner at the nozzle end 16 thereof. The cover 120 is provided with a downwardly curved dished portion 134 which is positioned beneath the slit openings 90 and 94 of the suction nozzle 84 when the cover is in the closed solid line position shown in FIG. 8. With the cover in this closed position, the pump activation switch 22 and blower motor switch 24 are operated so that clean fluid is sprayed from the fluid nozzle 46 onto the cover 120 to collect in the dished portion 134. This clean fluid is then sucked by the suction nozzle 84 into the dirty water tank 28, and this circulation of clean fluid through the handheld fluid extraction cleaner operates to clean and flush the suction nozzle 84, the conduit 82, the inlet ports 66 and the vertical conduit 68. When the handheld fluid extraction cleaner 10 has been used to remove fluid contaminants from a surface, the clean water tank 26 may be filled with a disinfectant which is then used to flush and disinfect the internal extraction cleaner components.

For normal use of the handheld fluid extraction cleaner 10, the hanger member 124 is pivoted to the broken line position in FIG. 8 to move the cover 120 away from the slit openings 90 and 94. A suitable clip, not shown, may be provided on the side wall of the casing 12 to hold the cover in the broken line position in FIG. 8.

Figure 9:
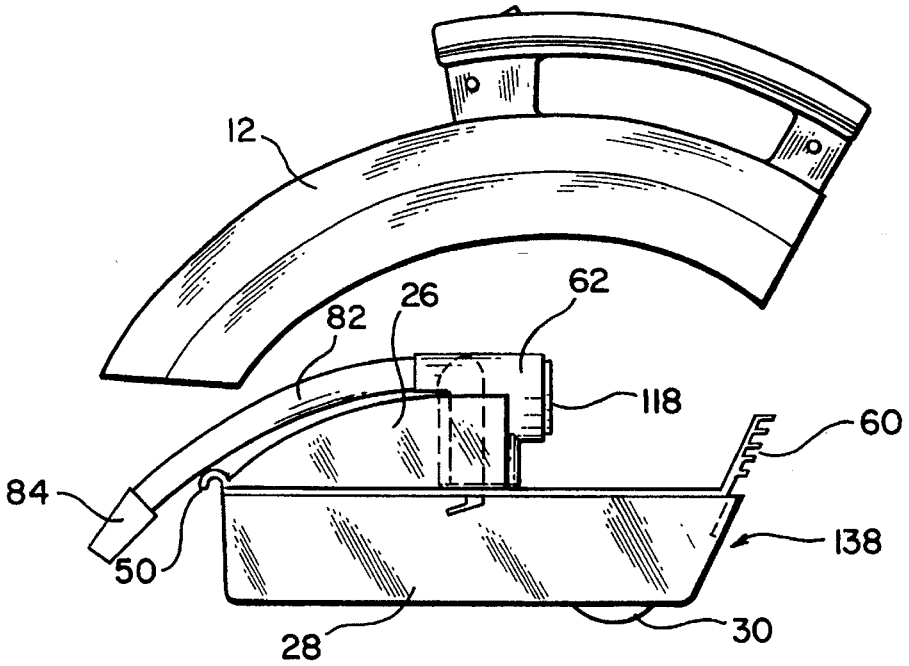
FIG. 9 is an exploded side elevational view of a second embodiment of the handheld fluid extraction cleaner of the present invention.

It is often desirable to employ a handheld fluid extraction cleaner in medical or other scientific facilities to remove spilled contaminants, such as contaminated blood. For some contaminants, it is sufficient to use the extraction cleaner 10 of FIG. 1 and fill the clean water tank 26 with a disinfectant or other neutralizing fluid for the contaminant which is being removed from an underlying surface. Once the contaminant is vacuumed into the dirty water tank 28, the cover 120 can be closed and the cleaner flushed with disinfectant solution. For some applications, however, this flushing of the cleaner is not sufficient, and a danger remains that internal components of the cleaner which have contacted the contaminant will remain contaminated. In these cases, the extraction cleaner 136 of FIG. 9 would be used. The components of this cleaner are the same as those previously described with respect to the extraction cleaner 10, and therefore, like components will be identified with the same reference numerals. In the extraction cleaner 136, all internal components of the cleaner which come into contact with a contaminant vacuumed from a surface are formed as a one piece unit 138. This unit is molded of an inexpensive plastic, or similar material, and forms a replaceable unit which is removed and replaced each time the cleaner is used. The one piece unit 138 includes the clean water tank 26, the dirty water tank 28, the plenum assembly 62, file conduit 82 and the suction nozzle 84. Where only a dirty water tank is required, the clean water tank 26 may be omitted from the one piece unit 138.

In use, the one piece unit 138 is snapped into the casing 12 using the curved flange 50 and the release clip 60. The remaining components of the cleaner, previously described, are mounted in the same manner in the casing 12, and do not come into contact with a contaminant which moves through the one piece unit 138. Since the one piece unit 138 is intended for only one use, the water sensor 114 is eliminated.

Figure 10:
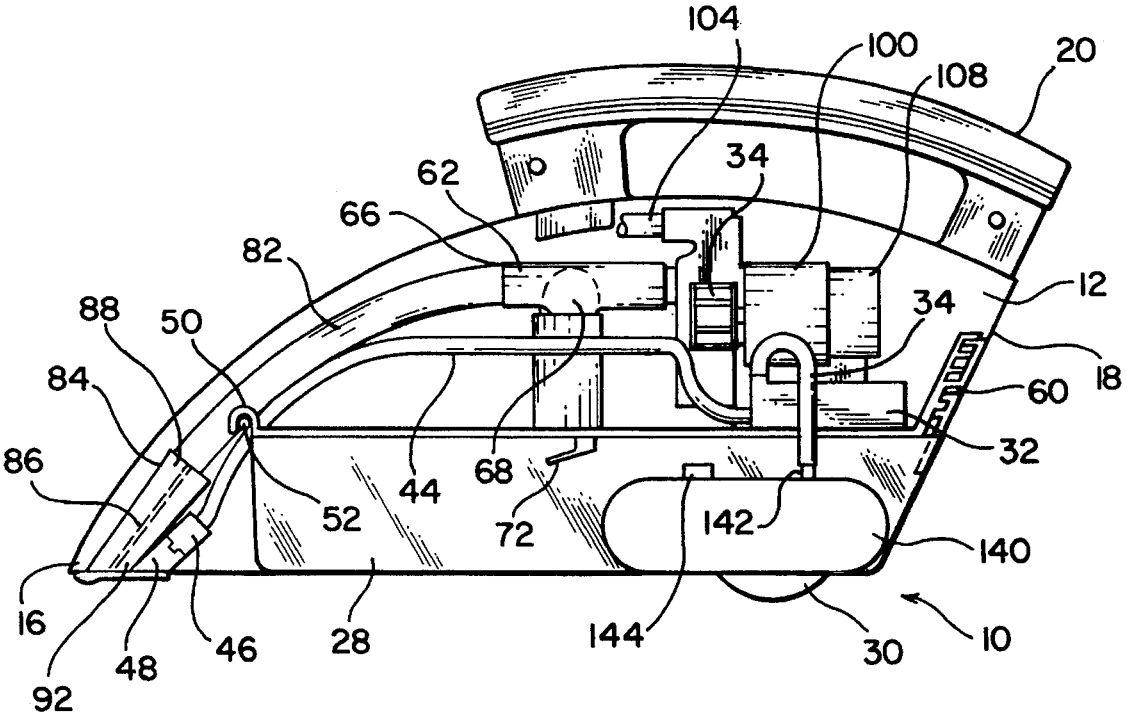
FIG. 10 is a cutaway side elevational view of a third embodiment of the handheld fluid extraction cleaner of the present invention.

In some instances, it is desirable to modify the handheld fluid extraction cleaner 10 of FIG. 1. This may be accomplished, as illustrated in FIG. 10, by eliminating the clean water tank 26 and replacing this tank with a collapsible fluid filled bladder 140. The bladder 140 rests within the dirty water tank 28 and is connected to the pump 32 by the inlet conduit 34. The inlet conduit is now removably connected to a fitting 142 on the bladder, and is of a length sufficient to permit the bladder to completely collapse within the dirty water tank. When the dirty water tank is removed from the casing 12, the bladder may be filled with water or other cleaning fluid through a capped inlet 144 and then replaced within the dirty water tank before it is inserted back into the casing 12. In this embodiment, the curved flange 50 is formed on the forward end of the dirty water tank. As the pump 32 removes water from the bladder 140, the bladder collapses providing room in the dirty water tank for fluid which is vacuumed in through the nozzle 84. The bladder may be formed of rubber or similar water tight collapsible material.

Figure 11:
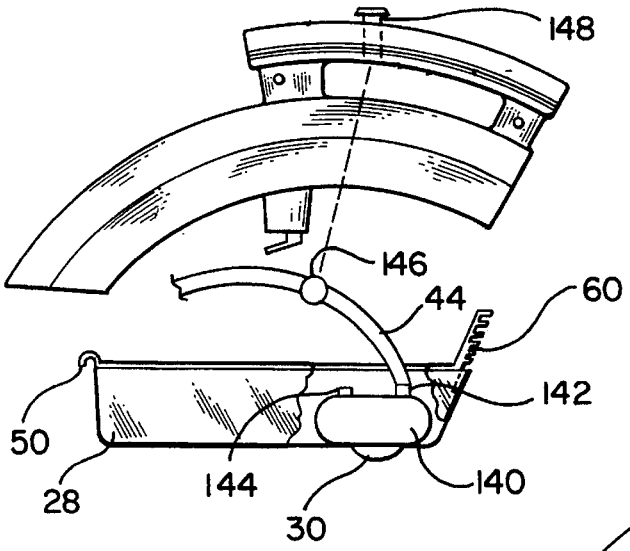
FIG. 11 is an exploded, partially cutaway view showing a fourth embodiment of the handheld extraction cleaner of the present invention.

When a bladder 140 is used, the pump 34 can often be eliminated and the output conduit 44 would then be directly connected to the fitting 142 to receive fluid directly from the bladder. As illustrated in FIG. 11, the fluid may be forced into the bladder under pressure to expand an elastic bladder, and when a valve 146 in the output conduit 44 is opened, the bladder will collapse and force fluid through the output conduit. The valve 146 can be operated by a suitable valve operator 148 on the handle 20.

Figure 12:
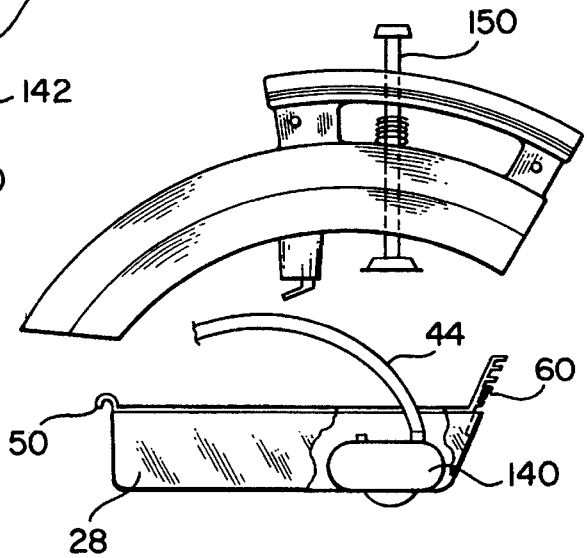
FIG. 12 is an exploded, partially cutaway view showing a fifth embodiment of the handheld extraction cleaner of the present invention.

Alternatively, a spring loaded plunger 150, or similar mechanical means for forcing fluid from the bladder 140 may be mounted to engage the bladder when the dirty water tank 28 is locked in place. As illustrated in FIG. 12, when the plunger is depressed, fluid is forced from the bladder through the output conduit 44.

Figure 13:
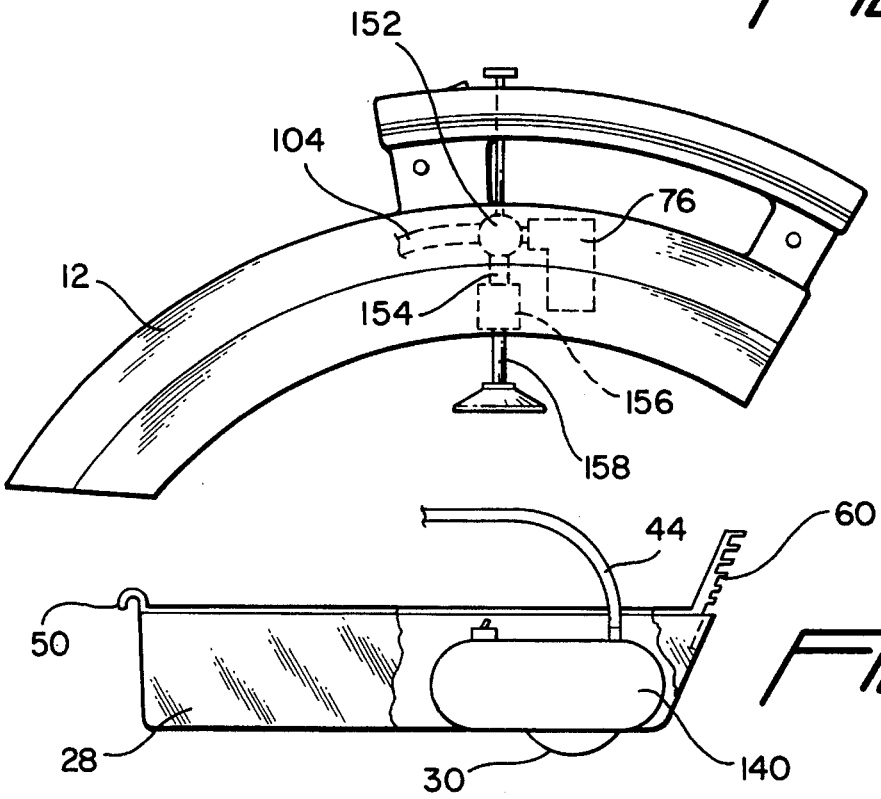
FIG. 13 is an exploded, partially cutaway view showing a sixth embodiment of the handheld extraction cleaner of the present invention.

Finally, as shown in FIG. 13, exhaust air from the vacuum chamber 76 which normally passes through the conduit 104 may be diverted by a valve 152 to a second conduit 154. The valve 152 is operated by any conventional mechanical valve operator 156 to selectively provide air under pressure to either the conduit 104 or conduit 154. The conduit 154 provides air to a piston cylinder 156 to drive a piston 158 outwardly from the cylinder to engage and compress the bladder 140. This causes fluid to be forced through the output conduit 44.

INDUSTRIAL APPLICABILITY

The handheld fluid extraction cleaner 10 operates effectively to apply cleaning fluid to surfaces which are angularly related to the horizontal. This fluid plus dirt or other foreign material from the surface to which the fluid is applied is then vacuumed back into a dirty water tank within the unit. When the fluid is contaminated, replaceable components which come into contact with the contaminated fluid may be removed and discarded. Also, the cleaner contains a self flushing capability which will permit internal components of the cleaner to be flushed with clean fluid from the clean water tank.

We claim:

1. A handheld liquid extraction cleaner for cleaning a surface comprising:

a cleaner body which includes a forward end, a rearward end, and a top wall extending between said forward and rearward ends, a fluid container mounted on said cleaner body between the forward and rearward ends thereof, said fluid container being spaced below said top wall, a plenum chamber including a column defining an elongate internal column conduit having an open end which opens into said fluid container, said column extending upwardly from said fluid container toward said top wall to a column upper end, vacuum means mounted on said cleaner body and operative to create a reduction of pressure in said plenum chamber, said vacuum means communicating with said plenum chamber in an area at said column upper end, a nozzle assembly formed at the forward end of said cleaner body for contacting said surface, said nozzle assembly including an internal nozzle chamber and a fluid receiving opening connecting said nozzle chamber to the exterior of said nozzle assembly, and a fluid conduit extending from said nozzle chamber through said plenum chamber to said fluid container, said fluid conduit extending into said plenum chamber at said column upper end and downwardly through said column conduit and opening into said fluid container at a point adjacent to the open end of said column.

2. The handheld extraction cleaner of claim 1 wherein a liquid responsive shut off means is mounted on said plenum chamber adjacent to the open end thereof, said fluid responsive shut off means operating to terminate operation of said vacuum means if fluid from said fluid container means enters said plenum chamber.

3. A handheld extraction cleaner for cleaning a surface comprising:

a cleaner body which includes a forward end, a rearward end, and a top wall extending between said forward and rearward ends, a fluid container mounted on said cleaner body between the forward and rearward ends thereof, said fluid container being spaced from said top wall, a plenum chamber on said cleaner body in spaced relationship to said forward and rearward ends thereof, said plenum chamber having an open end which opens into said fluid container, vacuum means mounted on said cleaner body and operative to create a reduction of pressure in said plenum chamber, said vacuum means communicating with said plenum chamber in an area adjacent to but spaced from said top wall, a nozzle assembly formed at the forward end of said cleaner body for contacting said surface, said nozzle assembly including an internal nozzle chamber and a fluid receiving opening connecting said nozzle chamber to the exterior of said nozzle assembly, fluid conduit means extending from said nozzle chamber to said fluid container and opening into said fluid container at a point adjacent to the open end of said plenum chamber, and pump means mounted on said cleaner body to pump fluid from said fluid container to said nozzle assembly, said pump means including a fluid intake conduit free for movement within said fluid container and a weight attached adjacent an open end of said fluid intake conduit to move said fluid intake conduit within said fluid container in response to inclination of said cleaner body.

4. A handheld extraction cleaner for cleaning a surface comprising:

a cleaner body which includes a forward end, a rearward end, and a top wall extending between said forward and rearward ends, a fluid container mounted on said cleaner body between the forward and rearward ends thereof, said fluid container means being spaced from said top wall, a plenum chamber on said cleaner body in spaced relationship to said forward and rearward ends thereof, said plenum chamber having an open end which opens into said fluid container, vacuum means mounted on said cleaner body and operative to create a reduction of pressure in said plenum chamber, said vacuum means communicating with said plenum chamber in an area adjacent to but spaced from said top wall, a nozzle assembly formed at the forward end of said cleaner body for contacting said surface, said nozzle assembly including an internal nozzle chamber and a fluid receiving opening connecting said nozzle chamber to the exterior of said nozzle assembly, and a fluid outlet opening, fluid conduit means extending from said nozzle chamber to said fluid container and opening into said fluid container at a point adjacent to the open end of said plenum chamber, pump means mounted on said cleaner body to pump fluid to said fluid outlet opening, and connector means on said nozzle assembly operative in a first position to permit fluid from said fluid outlet opening to be directed against said surface and in a second position to direct the fluid from said fluid outlet opening directly to said fluid receiving opening to provide self flushing of said handheld extraction cleaner.

5. A handheld extraction cleaner for cleaning a surface comprising:

a cleaner body which includes a forward end, a rearward end, and a top wall extending between said forward and rearward ends, a fluid container mounted on said cleaner body between the forward and rearward ends thereof, said fluid container being spaced from said top wall, a plenum chamber on said cleaner body means in spaced relationship to said forward and rearward ends thereof, said plenum chamber having an open end which opens into said fluid container, vacuum means mounted on said cleaner body and operative to create a reduction of pressure in said plenum chamber, said vacuum means communicating with said plenum chamber in an area adjacent to but spaced from said top wall, a nozzle assembly formed at the forward end of said cleaner body for contacting said surface, said nozzle assembly including an internal nozzle chamber and a fluid receiving opening connecting said nozzle chamber to the exterior of said nozzle assembly, fluid conduit means extending from said nozzle chamber to said fluid container and opening into said fluid container at a point adjacent to the open end of said plenum chamber, said fluid container and said plenum chamber being formed of disposable materials, said fluid container and said plenum chamber further being formed as a unitary removable unit, said cleaner body including mounting means for removably mounting said fluid container and plenum chamber on said cleaner body.

6. The handheld extraction cleaner of claim 1 wherein said plenum chamber includes a first chamber section at the upper end of said column which is opposite to the open end thereof, said first chamber section communicating with said column conduit and with said vacuum means, and a plenum fluid conduit extending from the upper end of said column through said column conduit in spaced relation thereto and through the open end of said column into said fluid container, said plenum fluid conduit forming a first section of said fluid conduit from said nozzle chamber, the fluid conduit from said nozzle chamber including a second conduit section connected between said nozzle chamber and said plenum fluid conduit.

7. The handheld extraction cleaner of claim 6 wherein said first chamber section extends laterally from the upper end of said column and said plenum fluid conduit includes a connection section which extends laterally from the upper end of said column and is connected to the second conduit section of said fluid conduit, said plenum fluid conduit curving from said connection section to pass downwardly away from said top wall through said column conduit.

8. The handheld extraction cleaner of claim 7 wherein said fluid container extends below said cleaner body and outwardly from the open end of said column toward the rearward end of said cleaner body, said fluid container having a bottom wall which is spaced from the open end of said plenum chamber and forms a bottom wall section for said extraction cleaner.

9. The handheld extraction cleaner of claim 8, wherein said cleaner body includes mounting means for removably mounting said fluid container on said body.

10. A handheld liquid extraction cleaner for cleaning a surface comprising:

a cleaner body which includes a forward end, a rearward end, and a top wall extending between said forward and rearward ends, fluid container means mounted on said cleaner body between the forward and rearward ends thereof, said fluid container means including a clean liquid container and a dirty liquid container, the fluid volume of said clean liquid container being less than one half the fluid volume of said dirty liquid container, a plenum chamber on said cleaner body in spaced relationship to said forward and rearward ends thereof, said plenum chamber extending to an open end which opens into said dirty liquid container substantially centrally thereof, vacuum means mounted on said cleaner body and operative to create a reduction of pressure in said plenum chamber, a nozzle assembly formed at the forward end of said cleaner body for contacting said surface, said nozzle assembly including an internal nozzle chamber and a fluid receiving opening connecting said nozzle chamber to the exterior of said nozzle means, and fluid conduit means extending from said nozzle chamber through said plenum chamber to said dirty liquid container and opening into said dirty liquid container at a point adjacent to the open end of said plenum chamber.

11. The handheld liquid extraction cleaner of claim 10, wherein said plenum chamber includes a column defining an elongate internal column conduit which extends to the open end of said plenum chamber, said column extending upwardly from said dirty liquid container toward said top wall to a column upper end, said vacuum means communicating with said plenum chamber in an area at said column upper end and said fluid conduit means extending through said plenum chamber at said column upper end and downwardly through said column conduit in spaced relationship to said column.

12. The handheld liquid extraction cleaner of claim 11 wherein said clean liquid container and said dirty liquid container are formed as a unitary removable unit, said cleaner body including mounting means for removably mounting said fluid container means on said cleaner body.

13. The handheld extraction cleaner of claim 12 wherein said fluid receiving opening is a slot formed at a first end of said nozzle chamber, said fluid conduit means opening into a second end of said nozzle chamber spaced from said slot, said second end being of reduced width relative to said first end.

14. The handheld extraction cleaner of claim 10 wherein a divider means is mounted on said nozzle assembly to divide said slot into two slot sections with a first slot section on a side of the divider means adjacent to the forward end of said cleaner body and a second slot section on a side of the divider means adjacent to the rearward end of said cleaner body, said divider means operating to contact said surface and space at least one of said slot sections above said surface regardless of the inclination of said nozzle assembly relative to said surface.

15. The handheld extraction cleaner of claim 13, wherein said nozzle chamber is bell-shaped in configuration.

16. The handheld liquid extraction cleaner of claim 10 wherein said fluid container means and said plenum chamber are formed as a unitary removable unit, said cleaner body including mounting means for removably mounting said fluid container means and said plenum chamber on said cleaner body.

17. A handheld liquid extraction cleaner for cleaning a surface comprising:

a cleaner body which includes a forward end, a rearward end, and a top wall extending between said forward and rearward ends, fluid container means mounted on said cleaner body between the forward and rearward ends thereof, said fluid container means being spaced from said top wall, a plenum chamber on said cleaner body in spaced relationship to said forward and rearward ends thereof, said plenum chamber extending to an open end which opens into said fluid container means, vacuum means mounted on said cleaner body and operative to create a reduction of pressure in said plenum chamber, a nozzle assembly formed at the forward end of said cleaner body for contacting said surface and including an internal nozzle chamber and a fluid receiving opening connecting said nozzle chamber to the exterior of said nozzle assembly, said nozzle chamber having chamber sidewalls shaped to provide a chamber which is substantially bell shaped in configuration with a first end containing said fluid receiving slot and a second end spaced from said first end which is of reduced width relative to said first end, and a fluid conduit communicating with said nozzle chamber and extending from the second end of said nozzle chamber through said plenum chamber into said fluid container means.

18. The handheld liquid extraction cleaner of claim 17 wherein a divider means is mounted on said nozzle assembly to divide said slot into two slot sections with a first slot section on a side of the divider means adjacent to the forward end of said cleaner body and a second slot section on a side of the divider means adjacent to the rearward end of said cleaner body, said first slot section being longer than said second slot section.

19. The handheld liquid extraction cleaner of claim 17 wherein a divider means is mounted on said nozzle assembly to divide said slot into two slot sections with a first slot section on a side of the divider means adjacent to the forward end of said cleaner body and a second slot section on a side of the divider means adjacent to the rearward end of said cleaner body, said divider means operating to contact said surface and space at least one of said slot sections above said surface regardless of the inclination of said nozzle assembly relative to said surface.

20. The handheld liquid extraction cleaner of claim 19 wherein said first slot section is longer than said second slot section.

21. The handheld liquid extraction cleaner of claim 17 wherein said vacuum means includes a vacuum blower chamber formed on said cleaner body in communication with said plenum chamber, a vacuum blower means mounted in said vacuum blower chamber to create a reduced pressure in said plenum chamber, said vacuum blower means further operating to create an exhaust air flow in said blower chamber, said nozzle assembly including a drying air discharge to direct air onto said surface, and said liquid extraction cleaner further including a drying air conduit connected between said vacuum blower chamber and said drying air discharge to conduct said exhaust air flow from said vacuum blower chamber to said drying air discharge.

22. The handheld liquid extraction cleaner of claim 17 wherein said fluid container means includes a clean liquid container and a dirty liquid container, the open end of said plenum chamber and said fluid conduit opening into said dirty liquid container, the nozzle assembly including a liquid outlet opening, and said liquid extraction cleaner further including pump means mounted on said cleaner body to pump liquid from said clean liquid container to said liquid outlet opening.

23. The handheld liquid extraction cleaner of claim 22 wherein connector means are provided on said nozzle assembly, said connector means operating in a first position to permit liquid from said liquid outlet opening to be directed against said surface and in a second position to direct liquid from said liquid outlet opening to said fluid receiving opening to provide self flushing of said handheld extraction cleaner.

24. The handheld liquid extraction cleaner of claim 23 wherein a divider means is mounted on said nozzle assembly to divide said slot into two slot sections with a first slot section on a side of the divider means adjacent to the forward end of said cleaner body and a second slot section on a side of the divider means adjacent to the rearward end of said cleaner body, said divider means operating to contact said surface and space at least one of said slot sections above said surface regardless of the inclination of said nozzle assembly relative to said surface.

25. The handheld liquid extraction cleaner of claim 24 wherein said vacuum means includes a vacuum blower chamber formed on said cleaner body in communication with said plenum chamber, a vacuum blower means mounted in said vacuum blower chamber to create a reduced pressure in said plenum chamber, said vacuum blower means further operating to create an exhaust air flow in said blower chamber, said nozzle assembly including a drying air discharge to direct air onto said surface, and said liquid extraction cleaner further including a drying air conduit connected between said vacuum blower chamber and said drying air discharge to conduct said exhaust air flow from said vacuum blower chamber to said drying air discharge.

26. The handheld extraction cleaner of claim 25 wherein said plenum chamber includes a column defining an internal column conduit which opens at said open end into said dirty liquid container, said column extending upwardly from said dirty liquid container toward said top wall to a column upper end, a vacuum port at the upper end of said column in communication with said vacuum blower chamber, and a plenum fluid conduit extending from the upper end of said column through said column conduit in spaced relation thereto and through the open end of said column into said dirty liquid container, said plenum fluid conduit forming a first section of said fluid conduit from said nozzle chamber, the fluid conduit frown said nozzle chamber including a second conduit section connected between said nozzle chamber and said plenum fluid conduit.

27. The handheld extraction cleaner of claim 26 wherein said plenum fluid conduit includes a connection section which extends laterally from the upper end of said column and is connected to the second conduit section of said fluid conduit, said plenum fluid conduit curving from said connection section to pass downwardly away from said top wall through said column conduit.

28. The handheld extraction cleaner of claim 27 wherein said dirty liquid container is bordered by a plurality of sidewalls, said plenum fluid conduit extending through the open end of said column into said dirty liquid container and including means to direct liquid toward at least one of said sidewalls.

29. The handheld extraction cleaner of claim 28 wherein said column opens into said dirty liquid container substantially centrally thereof, the fluid volume of said clean liquid container being less than one half the fluid volume of said dirty liquid container.

30. A handheld liquid extraction cleaner for cleaning a surface comprising:

a cleaner body which includes a forward end, a rearward end, and a top wall extending between said forward and rearward ends, fluid container means mounted on said cleaner body between the forward and rearward ends thereof, said fluid container means including a clean liquid container and a dirty liquid container, a plenum chamber on said cleaner body in spaced relationship to said forward and rearward ends thereof, said plenum chamber including a column defining an internal column conduit having an open end which opens into said dirty liquid container, vacuum means mounted on said cleaner body and operative to create a reduction of pressure in said plenum chamber, said vacuum means communicating with said plenum chamber, a nozzle assembly formed at the forward end of said cleaner body for contacting said surface, said nozzle assembly including an internal nozzle chamber and a fluid receiving opening connecting said nozzle chamber to the exterior of said nozzle assembly, a fluid conduit extending from said nozzle chamber through said column conduit to said dirty liquid container and opening into said dirty liquid container at a point adjacent to the open end of said column conduit, and pressure application means mounted on said cleaner body to apply pressure to liquid in said clean liquid container.

31. The handheld extraction cleaner of claim 30, wherein said pressure application means includes plunger means mounted to apply pressure to liquid in said clean liquid container.

32. The handheld extraction cleaner of claim 30 wherein said vacuum means includes a vacuum blower chamber formed on said cleaner body in communication with said plenum chamber, a vacuum blower means mounted in said vacuum blower chamber to create a reduced pressure in said plenum chamber, said vacuum blower means further operating to create an exhaust air flow in said blower chamber, said pressure application means operating with said exhaust air flow to apply pressure to liquid in said clean liquid container.

33. The handheld extraction cleaner of claim 30 wherein said clean fluid container includes at least one resilient wall, said pressure application means operating to apply pressure to said resilient wall.

34. The handheld extraction cleaner of claim 10 wherein said clean liquid container includes resilient collapsible walls.

* * * * *